US012767300B2

(12) United States Patent
Burner

(10) Patent No.: US 12,767,300 B2
(45) Date of Patent: Oct. 20, 2026

(54) WING SAIL

(71) Applicant: OZONE KITES LTD., Livingstone (GB)

(72) Inventor: Simon Burner, Castelldefels (ES)

(73) Assignee: OZONE KITES LTD., Livingstone (GB)

( * ) Notice: Subject to any disclaimer, the term of this patent is extended or adjusted under 35 U.S.C. 154(b) by 398 days.

(21) Appl. No.: 18/337,851

(22) Filed: Jun. 20, 2023

(65) Prior Publication Data

US 2024/0239459 A1 Jul. 18, 2024

(30) Foreign Application Priority Data

Jan. 12, 2023 (EP) ..... 23151274

(51) Int. Cl.
*B63H 9/061* (2020.01)

(52) U.S. Cl.
CPC ..... *B63H 9/0615* (2020.02)

(58) Field of Classification Search
CPC ..... B63H 9/04; B63H 9/06; B63H 9/0615
See application file for complete search history.

(56) References Cited

U.S. PATENT DOCUMENTS 4,708,078 A * 11/1987 Legaignoux ..... B64D 17/025 244/145
4,846,424 A * 7/1989 Prouty ..... A63H 27/08 244/152
6,289,833 B1 * 9/2001 Kirk ..... B63H 9/04 114/39.21
6,520,454 B2 * 2/2003 Winner ..... B63H 8/16 244/155 A (Continued)

FOREIGN PATENT DOCUMENTS

CN 109178232 A * 1/2019 ..... B63H 9/0615
CN 118434632 A * 8/2024 ..... B64C 31/06

(Continued)

OTHER PUBLICATIONS

Notice of Opposition for EP patent application No. 23151274.0, dated Mar. 9, 2026, 39 pages.

(Continued)

*Primary Examiner* — Joshua J Michener
*Assistant Examiner* — Aaron M Rodziwicz
(74) *Attorney, Agent, or Firm* — Chambliss, Bahner & Stophel, P.C.; Stephen D. Adams

(57) ABSTRACT

A wing sail comprising a first inflatable strut (10) extending in a width direction (Wd), a second inflatable strut (20) extending in a length direction (Ln) from the first inflatable strut, at least one handle (25, 26) mounted on the second inflatable strut, and first and second sail sheets (30, 35) that are spaced apart from one another in a height direction (He). The first inflatable strut (10) defines a leading edge (12) of the wing sail. The first and second sail sheets (30, 35) each comprise a front edge (35F) and a rear edge (35R) that are opposite to one another, wherein the front edges both connect to the first inflatable strut, and wherein the first and second sail sheets both extend rearwardly away from the first inflatable strut towards a trailing edge (40) of the wing sail.

15 Claims, 4 Drawing Sheets

(56) References Cited

U.S. PATENT DOCUMENTS

| | | | | | |
|---|---|---|---|---|---|
| 7,032,864 | B2 * | 4/2006 | Logosz | B63H 8/12 | 244/35 R |
| 7,494,093 | B2 * | 2/2009 | Legaignoux | B64C 31/06 | 244/155 A |
| 8,534,609 | B2 * | 9/2013 | Stiewe | B64C 31/06 | 244/155 A |
| 8,844,875 | B1 * | 9/2014 | Stiewe | B64C 31/06 | 244/155 A |
| 9,511,836 | B2 * | 12/2016 | Berrang | B63H 8/18 | |
| 2004/0188567 | A1 * | 9/2004 | Logosz | B64C 31/06 | 244/146 |
| 2004/0195435 | A1 * | 10/2004 | Logosz | B64C 31/06 | 244/15 |
| 2005/0127240 | A1 * | 6/2005 | Culp | B63H 9/072 | 244/15 |
| 2005/0230556 | A1 * | 10/2005 | Legaignoux | B64C 31/06 | 244/153 R |
| 2006/0192055 | A1 * | 8/2006 | Shogren | B63H 8/12 | 244/145 |
| 2009/0179112 | A1 * | 7/2009 | Gu | B32B 7/12 | 428/339 |
| 2009/0277997 | A1 * | 11/2009 | Shogren | B63H 8/14 | 244/153 R |
| 2025/0026504 | A1 * | 1/2025 | Sushko | B64U 10/30 | |

FOREIGN PATENT DOCUMENTS

| | | | | | |
|---|---|---|---|---|---|
| DE | 10237034 | A1 * | 2/2004 | B63H 8/16 | |
| DE | 102007034445 | A1 * | 1/2009 | B63H 9/0615 | |
| DE | 102006018444 | B4 * | 8/2010 | B63H 8/18 | |
| DE | 102009009305 | B4 | 8/2010 | | |
| DE | 102015117708 | A1 * | 5/2016 | B63H 9/0615 | |
| DE | 102016011434 | A1 * | 3/2018 | B63H 9/0615 | |
| DE | 102016011435 | A1 * | 3/2018 | H02S 30/20 | |
| DE | 202021101663 | U1 | 6/2021 | | |
| EP | 0202271 | B1 * | 5/1989 | B64C 31/036 | |
| EP | 2285667 | A1 | 2/2011 | | |
| EP | 3225545 | A1 | 10/2017 | | |
| EP | 3649282 | B1 * | 6/2022 | D03D 15/283 | |
| ES | 2952068 | T3 * | 10/2023 | B63H 8/10 | |
| ES | 2984553 | T3 * | 10/2024 | B63H 8/16 | |
| FR | 2544275 | A1 * | 10/1984 | B63H 8/10 | |
| FR | 2854373 | A1 | 11/2004 | | |
| FR | 2873983 | A1 | 2/2006 | | |
| FR | 3027281 | A1 * | 4/2016 | B63H 8/21 | |
| FR | 3078949 | A1 * | 9/2019 | B64D 17/025 | |
| IT | 20120011 | A1 | 11/2013 | | |
| WO | 0204291 | A1 | 1/2002 | | |
| WO | WO-2005000671 | A2 * | 1/2005 | B64U 20/70 | |
| WO | 2013123604 | A1 | 8/2013 | | |
| WO | WO-2018050145 | A1 * | 3/2018 | B64C 31/06 | |
| WO | 2021084024 | A1 | 5/2021 | | |
| WO | WO-2023195035 | A1 * | 10/2023 | B63H 8/10 | |

OTHER PUBLICATIONS

Ozone Fusion FAQs and riding tips with designer, Simon Burner, https://www.youtube.com/watch?v=nj9DMPcwODU, published May 17, 2024 by Ozone Kites, accessed Mar. 23, 2026.

Transformation kite to wing, https://www.youtube.com/watch?v=khwGJ9leyg8, published Feb. 27, 2026 by G, 3 accessed Mar. 23, 2026.

* cited by examiner

WING SAIL

FIELD OF THE INVENTION

The present invention relates to a wing sail, and in particular to an inflatable wing sail, for example for use in foil boarding.

BACKGROUND OF THE INVENTION

Wing sails have become much more popular in recent years, largely owing to technological advances that allow them to be made of inflatable rather than heavier and more rigid materials. The light weight and inherent buoyancy of an inflatable wing sail makes it ideal for use on the water, and they are easy to setup and pack away afterwards.

Wing sails currently on the market typically comprises a first inflatable strut extending in a width direction, a second inflatable strut extending in a length direction from the first inflatable strut, and sail sheet spanning between the first and second inflatable struts. The first inflatable strut defines a leading edge of the wing sail and the second inflatable strut comprises two handles spaced apart along the length direction and by which a user can control the wing sail.

The first and second inflatable struts need to hold the sail sheet taut, to prevent flapping and increased drag as the wing sail is presented to the wind at a wide range of angles. The requirement for a taut sail greatly constrains the geometry of the wing sail, as only a limited range of sail geometries can be stretched between the struts.

Since the first and second struts are inflatable, they need to be much thicker than if they were formed of rigid materials to hold the sail sheet taut. However, the thicker the first strut that defines the leading edge, the less aerodynamically efficient the wing becomes. This limits the performance of the inflatable wing, and inflatable wings are typically used with hydrofoil boards in which the higher hydrodynamic efficiency compensates for the lower aerodynamic efficiency of the wing, resulting in good overall sailing performance.

It is therefore an object of the invention to provide an improved wing sail.

SUMMARY OF THE INVENTION

According to the invention, there is provided a wing sail comprising a first inflatable strut extending in a width direction, a second inflatable strut extending in a length direction from the first inflatable strut, at least one handle mounted on the second inflatable strut, and first and second sail sheets that are spaced apart from one another in a height direction. The first inflatable strut defines a leading edge of the wing sail. The first and second sail sheets each comprise a front edge and a rear edge that are opposite to one another, wherein the front edges both connect to the first inflatable strut, and wherein the first and second sail sheets both extend rearwardly away from the first inflatable strut towards a trailing edge of the wing sail. A user can grasp the handle(s) to hold and control the wing sail during use.

One of the reasons for the reduced aerodynamic efficiency of known inflatable wing sails, is that airflow passing in the length direction over the first inflatable strut is subject to a sudden reduction in the height of the wing sail as the air passes from the first inflatable strut (which is very thick) to the sail sheet (which is very thin). This sudden change in the height of the wing sail leads to turbulence in the region where the sail sheet connects to the first inflatable strut.

Therefore, the wing sail disclosed herein comprises two sail sheets spaced apart from one another in the height direction, so that the airflow passing over the first inflatable strut is not subject to such a large and sudden reduction in the height of the wing sail as occurs with known wing sails. This improves the aerodynamic efficiency of the wing sail, enabling users to take better advantage of the wind. Accordingly, the first sail sheet may extend over or from an uppermost surface of the first inflatable strut and the second sail sheet may extend over or from a lowermost surface of the first inflatable strut. The first and second sail sheets may each span from the first to the second inflatable struts.

The first sail sheet may define an upper surface of the wing sail and the second sail sheet may define a lower surface of the wing sail. The length of the wing sail typically extends from the leading edge at the front of the wing sail to the trailing edge at the rear of the wing sail.

The rear edges of the first and second sail sheets may be joined together along the trailing edge, and so extend along a full length of the wing sail. Thus the wind may be guided along the full length of the wing sail by the first and second sail sheets, avoiding steps or discontinuities that could disrupt the wind flow and reduce aerodynamic efficiency. This is particularly useful when the wing sail is moving upwind.

The rear edge of the first sail sheet may be located at the trailing edge of the wing sail and the rear edge of the second sail sheet may be located between 15% and 100% of the way in the length direction from the front edge of the second sail sheet to the trailing edge of the wing sail, over a majority of the full width of the wing sail. For example, the second sail sheet may only extend 15% of the way in the length direction from the front edge of the second sail sheet to the trailing edge of the wing sail, over a majority of the full width of the wing sail. This still provides a smooth surface for the wind to flow over without any sudden changes in the angle of the sail surface along the length of the wing sail, and reduces the weight of the wing sail.

The rear edge of the second sail sheet may be joined to the first sail sheet between the front and rear edges of the first sail sheet, providing a smooth transition from a length portion of the wing sail where both the first and second sail sheets are present to a length portion of the wing sail where only the first sail sheet is present.

Preferably, the rear edge of the second sail sheet may be located between 25% and 75% of the way in the length direction from the leading edge to a trailing edge of the wing sail, over a majority of the full width of the wing sail. The rear edge of the second sail sheet may be joined to the first sail sheet, and so the join may be between 25% and 75% of the way from the leading edge to the trailing edge over a majority of the full width of the wing sail.

More preferably, the rear edge of the second sail sheet or the join may be located between 33% and 66% of the way in the length direction from the leading edge to a trailing edge of the wing sail, over a majority of the full width of the wing sail. This still provides a smooth surface for the wind to flow over without any sudden changes in the angle of the sail surface along the length of the wing sail, and making the second sail sheet shorter than the first sail sheet helps improve the performance of the wing sail when the wing sail is moving downwind. Still more preferably, the rear edge of the second sail sheet or the join may be between 50% and 66% of the way from the leading edge to the trailing edge over a majority of the full width of the wing sail, to provide an optimum balance between upwind and downwind performance.

The rear edge of the second sail sheet may be straight, for example aligned with the width direction, or the rear edge of the second sail sheet may curve rearwardly or be angled rearwardly as the rear edge of the second sail sheet extends away from the second inflatable strut.

Between the first and second sail sheets, one or more rib panels may extend rearwardly from adjacent the leading edge, to control the distance between the first and second sail sheets. The rib panels may each extend in the height and length directions, and may have upper and lower edges fixed to the first sail sheet and the second sail sheet, respectively. Each rib panel may taper along its length to reduce in height towards the trailing edge of the wing sail. Each rib panel may comprise one or more apertures that pass through the rib panel in the width direction. This allows the passage of fluids through the rib panel, for example air or water.

A centre panel similar to the rib panels may extend rearwardly from adjacent the leading edge, towards the trailing edge. The centre panel may extend in the height and length directions and set a spacing between an upper side of the second inflatable strut and the first sail sheet. The centre panel may have an upper edge that is fixed to the first sail sheet and a lower edge that is fixed to the upper side of the second inflatable strut. Thus, the second inflatable strut does not need to be so thick as to span the whole height of the wing sail. A frontmost edge of the centre panel may be spaced apart from the first inflatable strut by a gap, and so the centre panel and the first inflatable strut may not be directly joined to one another, to ease manufacturing of the wing sail.

The second inflatable strut preferably extends from the first inflatable strut at a point that is mid-way along the first inflatable strut. The second inflatable strut may extend perpendicular from the first inflatable strut at the point where the first and second inflatable struts meet one another. The first and second inflatable struts may each comprise a valve through which they may be inflated, or there may be a single valve through which both the first and second inflatable struts are inflated simultaneously, wherein interior inflation chambers of the first and second inflatable struts are in fluid communication with one another. It would be possible to add additional inflatable struts that also extended from the first inflatable strut in the length direction if desired.

The at least one handle mounted on the second inflatable strut may comprise two handles spaced apart along the length direction, thereby providing one handle for each hand of the user. The at least one handle may be three or more handles, to provide the user with a choice of which handles to grasp, or the at least one handle may be only one handle, the only one handle preferably long enough for the user to grasp the handle with both hands spaced apart from one another in the length direction.

The wing sail may be substantially symmetrical about the second inflatable strut, so that it is balanced about the handle(s) provided on the second inflatable strut for the user to control the wing sail. The second inflatable strut may extend from the leading edge of the wing sail to the trailing edge of the wing sail, and may be connected to the first and second sail sheets at the trailing edge. The trailing edge may be positioned on an uppermost surface of the second inflatable strut at the end of the second inflatable strut, and so only the second sail sheet is interrupted by the second inflatable strut, and the first sail sheet is uninterrupted by the second inflatable strut.

The extension of the first inflatable strut may curve towards the length direction as the first inflatable strut extends away from the second inflatable strut. Thus, whilst the first inflatable strut extends in the width direction to define the overall width of the wing sail, it may also extend in the length direction to provide an amount of back sweep to the wing sail. This back sweep helps the first inflatable strut keep the sail sheets taut, especially at or adjacent the trailing edge. The curve in the extension of the first inflatable strut towards the length direction may be a curve of over 45 degrees, and the majority of the curvature may occur in the final third of the extension of the first inflatable strut away from the second inflatable strut in the width direction.

The opposing ends of the first inflatable strut may extend to the trailing edge of the wing sail, so that each end of the first inflatable strut tensions the trailing edge that extends from the end of the first inflatable strut to the end of the second inflatable strut that is opposite from the end of the second inflatable strut that joins the first inflatable strut. The opposing ends of the first inflatable strut may extend in the length dimension to at least two thirds of the way along the length of the second inflatable strut from the first inflatable strut, to aid the ends of the first inflatable strut in tensioning the trailing edge of the wing sail.

The first sail sheet may extend continuously over the second inflatable strut whilst extending from one end of the first inflatable strut to the opposite end of the first inflatable strut. The first sail sheet may extend continuously over the whole of the second inflatable strut without any interruptions, to provide for smooth airflow over the top of the wing sail. The second sail sheet may be interrupted at the second inflatable strut to provide the user with access to the handle(s), and also to make space for the second inflatable strut.

The second inflatable strut may be higher than the height between the first and second sail sheets over the majority of the length of the second inflatable strut, particularly towards the trailing edge of the wing sail where the height between the first and second sail sheets is greatly diminished. The height of the second inflatable strut provides it with rigidity against forces exerted on the wing sail by the wind and the by user. The second sail sheet may comprise a slit that is aligned with the second inflatable strut and that is at the location(s) of the handle(s). The slit may result in the second sail sheet being formed as two distinct parts, one part extending from one side of the second inflatable strut and the other part extending from the other side of the second inflatable strut.

Each part of the second sail sheet is preferably joined to the second inflatable strut along the slit, to provide additional support to the second sail sheet. It is alternatively possible that each part of the second sail sheet may not extend all the way to the second inflatable strut. For example, each part of the second sail sheet may only extend as far as the rib closest to the corresponding side of the second inflatable strut.

The first inflatable strut may comprise an angle or bend in the height dimension at the point where it joins the second inflatable strut, to provide the wing sail with a dihedral angle and aid aerodynamic stability. The angle or bend may take place gradually and/or be distributed over a portion of the width of the first inflatable strut, the portion including the point where the first inflatable strut joins the second inflatable strut.

The first or second sail sheets may comprise air intake ports configured to inlet air to in between the first and second sail sheets. The air that is admitted through the inlet to between the first and second sheets will increase the air pressure between the sail sheets, acting against the pressure exerted on the outside of the sail sheets by the wind, thereby reducing any flapping of the sail sheets to improve aerodynamic efficiency. The apertures in the rib panels may allow the air from the air intake ports to pressurise substantially the whole of the volume between the sail sheets.

The wing sail may comprise an aperture adjacent an end of the first inflatable strut, the aperture passing through at least one of the first and second sail sheets and opening into an interior region between the first and second sail sheets. The aperture allows any water trapped between the first and second sheets to drain away, and also allows air entering the air intake ports to exit from the regions between the sheets. Preferably, such apertures are provided adjacent both ends of the first inflatable strut.

At each end of the first inflatable strut, the first sail sheet may extend from the uppermost surface of the first inflatable strut and the second sail sheet may extend from the lowermost surface of the first inflatable strut. The first and second sail sheets may slope towards one another in the height dimension as they extend in a direction towards the rear end of the second inflatable strut, and meet each other. The trailing edge may therefore comprise a portion where the height of the wing sail reduces in a direction along the width of the wing sail towards the second inflatable strut, which may aid aerodynamic stability. The part of the trailing edge where the first and second sail sheets slope towards one another may define the aperture that allows any water trapped between the first and second sheets to drain away.

Alternatively, the first sail sheet may extend from the uppermost surface of the first inflatable strut and the second sail sheet may extend from the lowermost surface of the first inflatable strut, with the rear edge of the second sail sheet being nearer the front of the wing sail than the rear edge of the first sail sheet. The rear edge of the second sail sheet may slope towards the first sail sheet in the height direction as the rear edge of the second sail sheet extends away from the first inflatable strut, until the rear edge of the second sail sheet meets and joins with the first sail sheet. This creates a portion of the wing sail where the height of the wing sail reduces in a direction along the width of the wing sail towards the second inflatable strut, which may aid aerodynamic stability. The part of the rear edge of the second sail sheet that slopes towards the first sail sheet may define the aperture that allows any water trapped between the first and second sheets to drain away.

DETAILED DESCRIPTION

Embodiments of the invention will now be described by way of non-limiting example only and with reference to the accompanying drawings, in which.

The figures are not to scale, and same or similar reference signs denote same or similar features.

Figure 1:
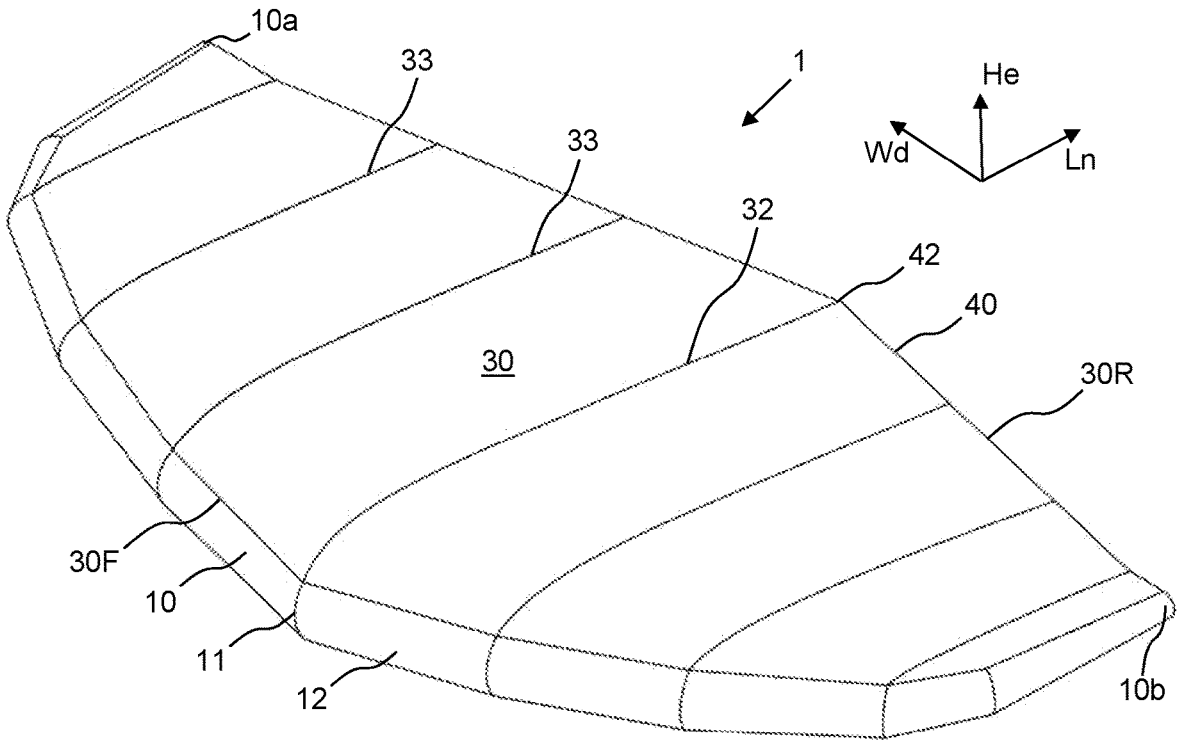
FIG. 1 shows a schematic perspective diagram of a wing sail in accordance with an embodiment of the invention, when viewed from above the wing sail.

The schematic perspective diagram of FIG. 1 shows the upper surface of a wing sail 1. The wing sail 1 may comprise an inflatable strut 10 that is generally cylindrical and that primarily extends in a width direction Wd from a first end 10*a* to a second end 10*b*. The inflatable strut 10 may have a frontmost portion 11 and the inflatable strut 10 may curve towards the length direction Ln as the inflatable strut extends from the frontmost portion 11 to the first and second ends 10*a* and 10*b*. The majority of the curvature may occurs in the final third of the width from the frontmost portion 11 to the first or second end 10*a* or 10*b*, and the total curvature from the frontmost portion 11 to the first or second end 10*a* or 10*b* may be over 70 degrees, as shown (also see FIG. 3). The first inflatable strut 10 may define the leading edge 12 of the wing sail.

The inflatable strut 10 may be formed of an inner airtight bladder and a woven fabric material may surround the inner airtight bladder, the inner airtight bladder having an inflation port (not shown in figs) for inflating the inner airtight bladder with air. Methods of manufacturing inflatable struts for wing sails are well known in the art, and so will not be described in any further detail herein.

The upper surface of the wing sail may be defined by a first sail sheet 30, and the first sail sheet 30 may be mounted on the uppermost surface of the first inflatable strut 10 for substantially the whole extension of the first inflatable strut 10 from the first end 10*a* to the second end 10*b*. The first sail sheet 30 may extend over the full area of the segment defined by the curvature of the first inflatable strut 10. The first sail sheet 30 may extend from the leading edge 12 to a trailing edge 40 of the wing sail, the front edge 30F of the first sail sheet connected to the first inflatable strut at the leading edge 12 and the rear edge 30R of the first sail sheet located at the trailing edge 40.

Also shown in FIG. 1 are seams 32 and 33, which may connect the first sail sheet 30*a* to underlying elements of the wing sail, as will become apparent from the description of FIGS. 5 and 6 further below.

Figure 2:
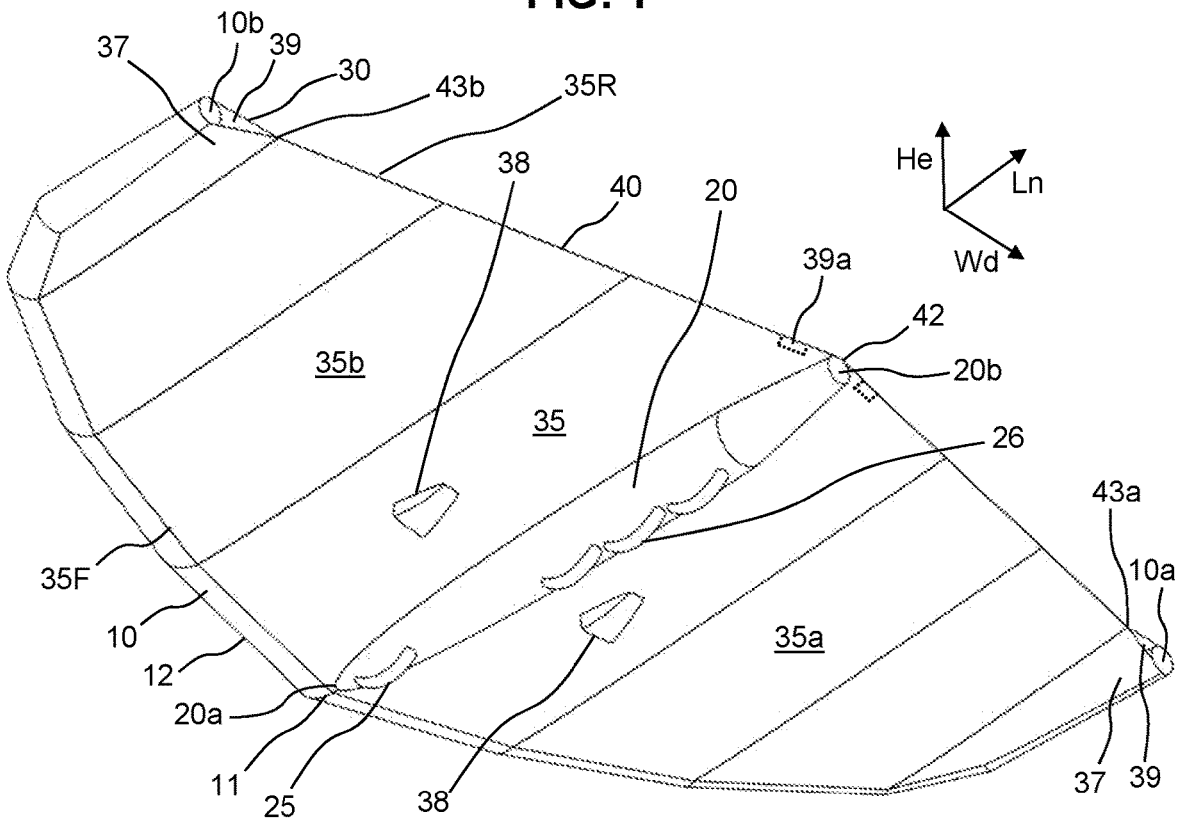
FIG. 2 shows another schematic diagram of the wing sail of FIG. 1, when viewed from beneath the wing sail.

FIG. 2 shows a schematic perspective diagram of the wing sail 1, when viewed from beneath the wing sail. The wing sail 1 comprises a second inflatable strut 20 which may extend in the length direction Ln from the frontmost portion 11 of the first inflatable strut 10. The second inflatable strut 20 may have a front end 20*a* joined to the frontmost portion 11, and a rear end 20*b* opposite the front end 20*a* and at the trailing edge 40 of the wing sail. An uppermost surface of the rear end 20*b* of the second inflatable strut may be connected to the trailing edge 40, at a rearmost portion 42 of the wing sail.

The second inflatable strut 20 may have a front handle 25 and a rear handle 26 that are spaced apart from one another along the second inflatable strut 20 in the length direction Ln. Each handle is formed by a loop of material extending in the length direction Ln, and allows a user to grasp the wing sail with their hand. There may be three different rear handles 26 aligned in a row and from which the user can select to grasp depending on individual requirements. The handles 25 and 26 may extend downwardly from the lowermost surface of the second inflatable strut 20.

The wing sail 1 may comprise a second sail sheet 35 that is beneath the first sail sheet 30, and the second sail sheet 35 may be spaced apart from the first sail sheet 30 except for at the trailing edge 40 of the wing sail. The front edge 35F of the second sail sheet may be connected to the first inflatable strut at the leading edge 12 and the rear edge 35R of the second sail sheet may be located at the trailing edge 40.

The lower surface of the wing sail may be primarily defined by the second sail sheet 35, and the second sail sheet 35 may be mounted on the lowermost surface of the first inflatable strut 10 for substantially the whole extension of the first inflatable strut 10 from the first end 10*a* to the second end 10*b*. The second sail sheet 35 may extend over the full area of the segment defined by the curvature of the first inflatable strut 10, except for an area of interruption of the second sail sheet 35 by the second inflatable strut 20. The interruption of the second sail sheet 35 by the second inflatable strut 20 may split the second sail sheet 35 into a first part 35*a* and a second part 35*b*. The first part 35*a* and the second part 35*b* may each be joined to the second inflatable strut along the slit and at opposing sides of the second inflatable strut, along the seams 27*a* and 27*b*, respectively.

The first and second sail sheets 30 and 35 may be spaced apart from one another by the height of the first inflatable strut 10 at the leading edge 12, and the second sail sheet 35 may slope upwardly towards the first sail sheet 30 until the second sail sheet 35 meets and joins with the first sail sheet 30 at the trailing edge 40, on the uppermost surface of the first inflatable strut 10.

The first and second sail sheets 30 and 35 may extend from the uppermost and lowermost surfaces of the first inflatable strut at each end 10*a* and 10*b*, and then slope towards one another along the trailing edge 40 until they join together at points 43*a* and 43*b*. The trailing edge 40 may therefore comprise portions 37 where the height of the wing sail reduces in the width direction towards the second inflatable strut.

Figure 5:
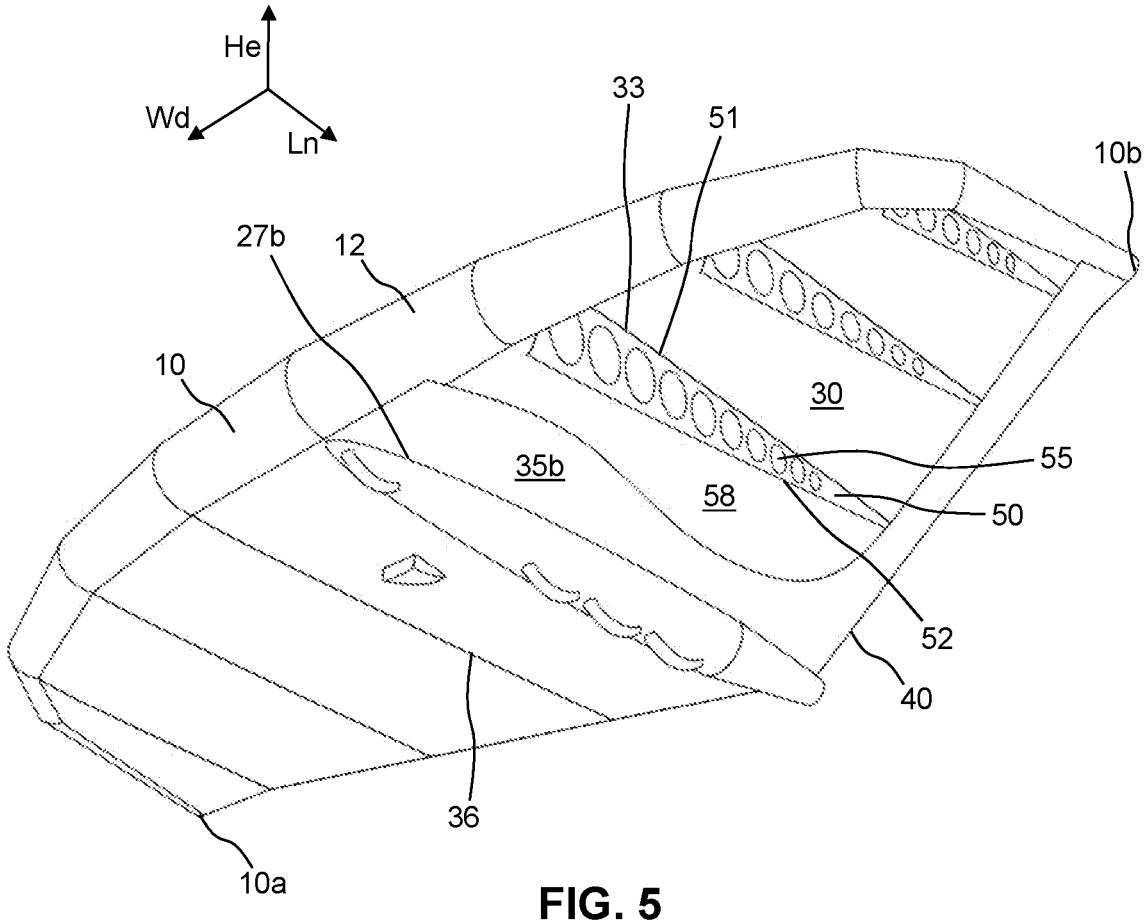
FIG. 5 shows a schematic diagram of the wing sail of FIG. 1, when viewed from beneath the wing sail, and with part of a lower sail sheet of the wing sail cut away to reveal internal rib panels of the wing sail.

Between the first end 10*a* of the first inflatable strut and the point 43*a* where the first and second sail sheets 30 and 35 join one another, the first and second sail sheets are spaced apart from one another and so define an aperture 39 that leads into an interior region 58 of the wing sail, between the first and second sail sheets 30 and 35 (see FIG. 5). Similarly, between the second end 10*b* of the first inflatable strut and the point 43*b* where the first and second sail sheets 30 and 35 join one another, the first and second sail sheets are spaced apart from one another and so define another aperture 39 that leads into the interior region of the wing sail, between the first and second sail sheets 30 and 35. One function of the apertures 39 is to allow any water that becomes trapped between the first and second sail sheets 30 and 35 to exit from the wing sail, to avoid the wing sail from becoming heavy and/or unwieldly.

The wing sail may further comprise air intake ports 38 built into the second sail sheet 35. The air intake ports 38 may face towards the leading edge 12 and direct air from the leading edge 12 through the second sail sheet 35 and into the interior region between the first and second sail sheets. The air intake ports 38 may be positioned in the width direction nearer to the second inflatable strut 20 than to the ends 10*a* and 10*b* of the first inflatable strut, and may be positioned in the length direction nearer to the leading edge 12 than to the trailing edge 40. Air that enters the interior region through the air intake ports 38 may exit the interior region through the apertures 39. The apertures 39 may face rearwardly in the length direction, so that air exiting from the apertures 39 flows in the same direction as air already passing over the wing sail from the leading edge 12 to the trailing edge 40. In some embodiments, each aperture 39 may be partly or fully filled with an extra panel, to produce a higher air pressure between the first and second sail sheets. Apertures 39*a* may additionally be formed along the rearmost portion 42 of the trailing edge 40, for example by not joining the first and second sail sheets 30 and 35 together with one another at one or more points along the rearmost portion 42. This may be particularly advantageous in the case where the apertures 39 are fully blocked with the extra panels.

The apertures 39*a* formed along the rearmost portion 42 of the trailing edge are particularly advantageous when the wing sail has an angle of dihedral, since then the rearmost portion 42 will be the lowest portion of the trailing edge and water will tend to drain towards the rearmost portion 42 and out of the apertures 39*a*.

Figure 3:
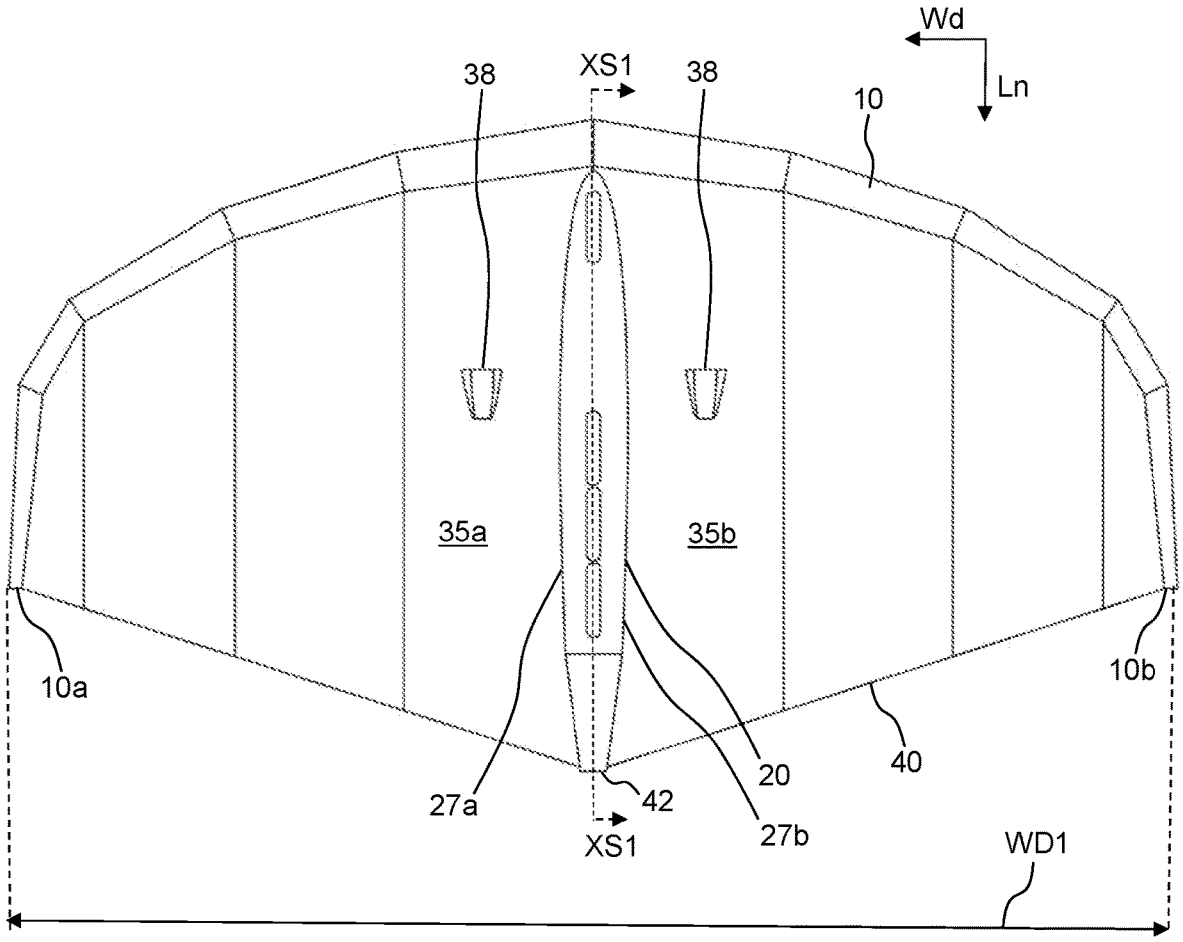
FIG. 3 shows a schematic plan diagram of the wing sail of FIG. 1, when viewed from beneath the wing sail.

The schematic diagram of FIG. 3 shows a plan view from beneath the wing sail 1, in which the outline shape of the wing sail can be more easily seen. The wing sail may be symmetrical about the second inflatable strut 20. The opposing ends 10*a* and 10*b* of the first inflatable strut may extend in the length direction to more than two thirds of the way along the length of the second inflatable strut 20 from the first inflatable strut 10, to aid the ends of the first inflatable strut in tensioning the trailing edge of the wing sail.

The second sail sheet 35 may extend from the leading edge 12 to the trailing edge 40 over the full width WD1 of the wing sail. Therefore, the rear edge 35R of the second sail sheet may be located 100% of the way in the length direction from the front edge 35F to the trailing edge 40 of the wing sail, over the full width of the wing sail. In alternative embodiments, the rear edge 35R of the second sail sheet may be located 100% of the way in the length direction from the front edge 35F to the trailing edge of the wing sail, over less than the full width of the wing sail, for example over a majority (greater than 50%) of the full width WD1 of the wing sail.

Figure 4:
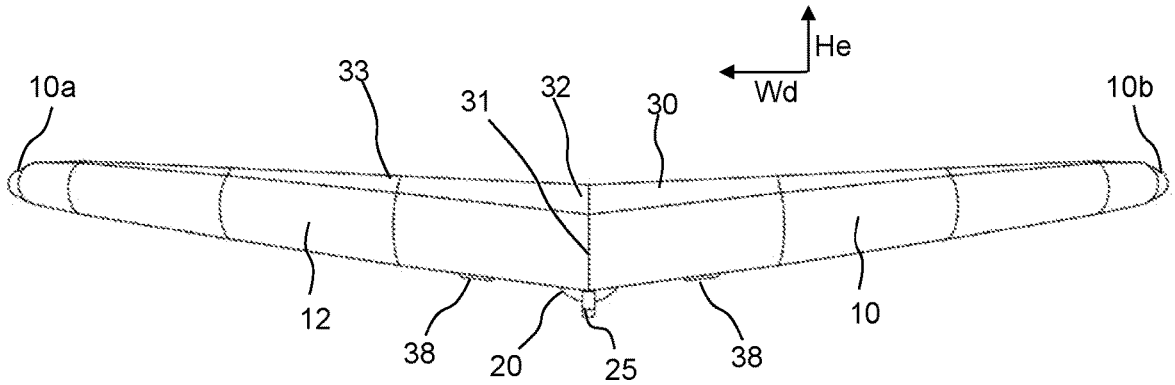
FIG. 4 shows a schematic elevational diagram of the wing sail of FIG. 1, when viewed from the front of the wing sail.

The schematic diagram of FIG. 4 shows a front elevational view of the wing sail 1, in which the front profile of the wing sail can be more easily seen. The majority of the front profile is defined by the first inflatable strut 10. The second inflatable strut 20 can be seen protruding from beneath the wing sail, with its handle 25, and the bottoms of the air intake ports 38 can also be seen. The first sail sheet 30 is also visible at the top of the wing sail, and the first sail sheet 30 may rise higher than the first inflatable strut 10 for an initial portion of the distance from leading edge to the trailing edge, as shown.

FIG. 4 also shows how the first inflatable strut 10 may have an angled portion 31 at the midpoint between the ends 10*a* and 10*b*, where the first inflatable strut 10 joins the second inflatable strut 20. The angled portion 31 angles the first inflatable strut 10 in the height direction He to provide the wing sail with a dihedral angle.

The schematic diagram of FIG. 5 shows another perspective view of the wing sail 1 from beneath, but with part of the second sail sheet 35 cut away so that the interior region 58 of the wing sail can be seen. The wing sail may comprise a plurality (six in this embodiment) of rib panels 50. Each rib panel 50 may extend from adjacent the leading edge 12 to adjacent the trailing edge 40, to control the distance between the first and second sail sheets 30 and 35. The rib panels 50 may each extend in the height and length directions, and may each have an upper and a lower edge 51 and 52. Each upper edge 51 may be attached to the first sail sheet 30 along a respective seam 33 (see FIG. 1), and each lower edge 52 may be attached to the second sail sheet 35 along a respective seam 36.

Each rib panel 50 may taper along its length to reduce in height towards the trailing edge 40 of the wing sail. Each rib panel 50 may comprise a series of apertures 55 that pass through the rib panel in the width direction. These apertures 55 allow the passage of fluids through the rib panel, for example air to pass from the intake ports 38 to the apertures 39 (see FIG. 2), or for any water that ingresses into the interior region 58 to exit via the apertures 39 rather than becoming trapped.

FIG. 5 shows the part 35*b* of the second sail sheet 35 connected to the second inflatable strut 20 along seam 27*b*. Alternatively, the second sail sheet 35 may not be directly connected to the second inflatable strut 20, and may simply rest against the second inflatable strut 20. Or, the slit in the second sail sheet 35 may be made much larger than the width of the second inflatable strut r 20 such that the part 35*b* of the second sail sheet does not span to the second inflatable strut 20 and is instead supported by the rib 50 closest to the second inflatable strut, and so the seam 27*b* is omitted. Similarly, the part 35*a* of the second sail sheet does not span to the second inflatable strut 20 and is instead supported by the rib 50 closest to the other side of the second inflatable strut, and so the seam 27*a* (see FIG. 3) is omitted.

Figure 6:
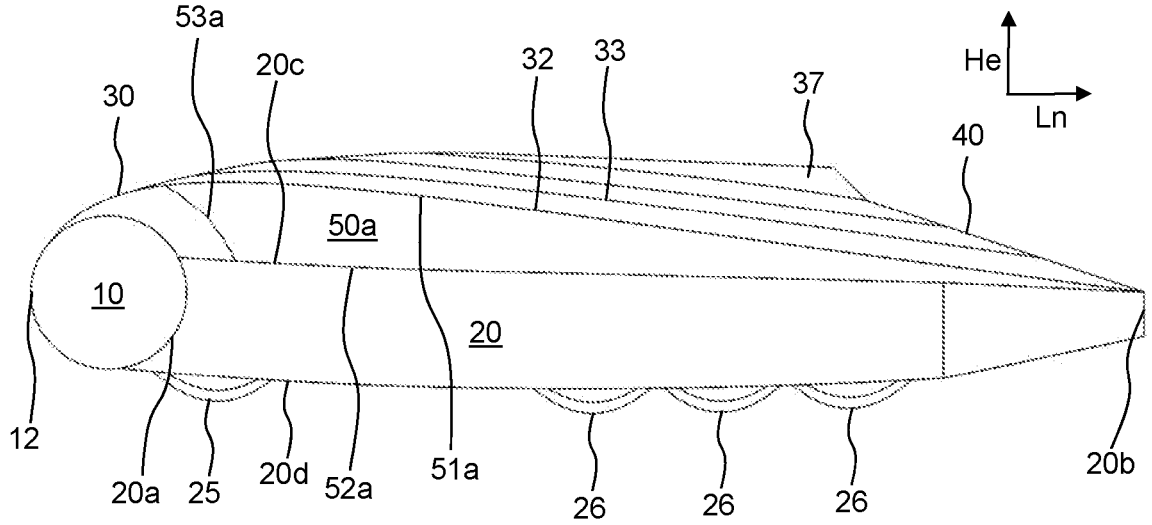
FIG. 6 shows a cross-sectional view of the wing sail of FIG. 1, which has been taken looking in along line XS1 marked on FIG. 3.

The schematic diagram of FIG. 6 shows a cross-sectional view looking in from line XS1 marked on FIG. 3. The cross-section is taken half way along the width of the wing sail in a plane extending in the height and length directions. As shown, the first inflatable strut 10 may have a circular cross-section and the front end 20*a* of the second inflatable strut 20 may be joined to the first inflatable strut 10.

The handles 25 and 26 may extend downwardly from a lower surface 20*d* of the second inflatable strut, as shown. The lower surface 20*d* of the second inflatable strut 20 may be convex in a direction along the length of the second inflatable strut, so that the lower surface at each end 20*a* and 20*b* of the second inflatable strut is higher than the lower surface half way along the length of the second inflatable strut. This shape helps the second inflatable strut resist forces that would tend to flex the ends of the second inflatable strut towards the user.

The seams 32 and 33 are visible at the top surface of the wing sail in FIG. 6, and so is the shape of the portion 37 where the height of the wing sail may reduce in the width direction towards the second inflatable strut. The seams 33 are connected to the upper edges 51 of the rib panels 50 as described with reference to FIG. 5 above, however FIG. 6 shows how the seam 32 is connected to an upper edge 51*a* of a centre panel 50*a*.

The centre panel 50*a* may extend from adjacent the leading edge 12 to adjacent the trailing edge 40, to control the distance between the first sail sheet 30 and the second inflatable strut 20. The centre panel 50*a* may extend in the height and length directions, and may have the upper edge 51*a* and a lower edge 52*a*. The upper edge 51*a* may be attached to the first sail sheet 30 along the seam 33 and the lower edge 52*a* may be attached to an upper surface 20*c* of the second inflatable strut. The centre panel 50*a* has a frontmost edge 53*a* running from the upper edge 51*a* to the lower edge 52*a*, and the frontmost edge 53*a* is spaced apart from the first inflatable strut 10 by a gap, as shown.

Figure 7:
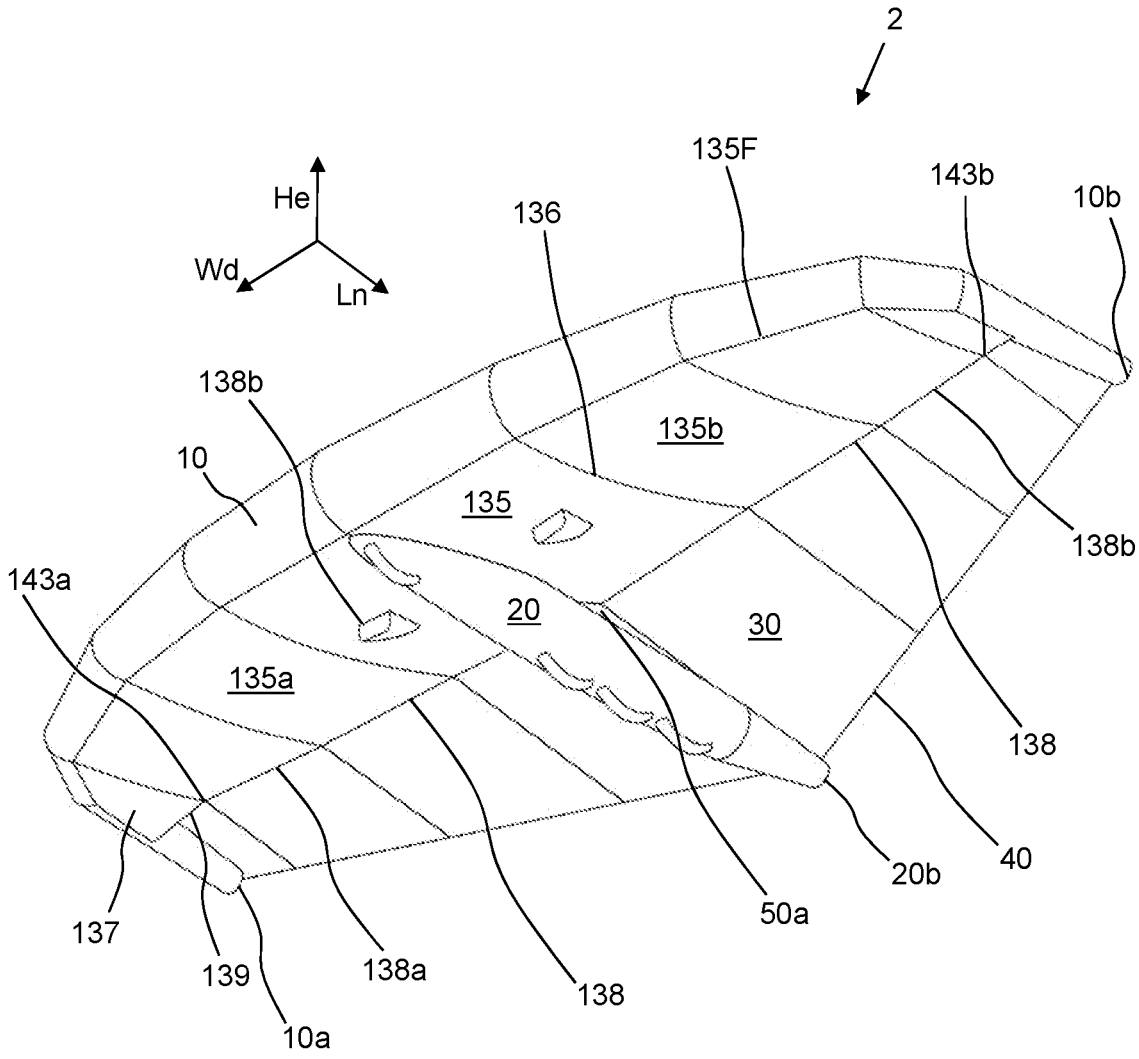
FIG. 7 shows a schematic perspective diagram of a wing sail in accordance with another embodiment of the invention, when viewed from beneath the wing sail.

The schematic perspective diagram of FIG. 7 shows a wing sail 2 in accordance with another embodiment of the invention, when viewed from beneath the wing sail. The wing sail 2 may be the same as the wing sail 1 of FIG. 1, except for that the second sail sheet may have a shorter length than the first sail sheet.

The wing sail 2 comprises the same first inflatable strut 10, second inflatable strut 20, first sail sheet 30 and centre panel 50*a* as the wing sail 1. Instead of the second sail sheet 35 in the two parts 35*a* and 35*b*, the wing sail 2 has a second sail sheet 135 in two parts 135*a* and 135*b*. The difference from the second sail sheet 35 is that the second sail sheet 135 has a rear edge 138 that is not at the trailing edge of the wing sail, but that is roughly half way (50%) along the length of the wing sail for the majority of the width of the wing sail, as shown. It will be appreciated that the width portions of the wing sail adjacent the far ends 10*a* and 10*b* may only have a small length of the second sail sheet 135, or may not have any of the second sail sheet 135 at all.

The rear edge 138 is shown in FIG. 7 as being aligned in the width direction across the full width of the second sail sheet, however the rear edge 138 could follow a different path in alternate embodiments. For example, in an alternate embodiment, 26% of the full width WD1 (see FIG. 3) of the wing sail may have the rear edge of the first part 135*a* located between 15% and 100% of the way in the length direction from the front edge 135F to the trailing edge 40 of the wing sail, and a different 26% of the full width WD1 of the wing sail may have the rear edge of the second part 135*b* located between 15% and 100% of the way in the length direction from the front edge 135F to the trailing edge 40 of the wing sail.

The wing sail 2 has rib panels similar to the rib panels 50 of the wing sail 1, but the rib panels in the wing sail 2 are shorter than the rib panels 50 to match the shorter length of the second sail sheet 135.

The rear edge 138 may be joined to the first sail sheet 30 at a seam 138*a*, the seam 138*a* beginning at a point 143*a* and ending at a point 143*b*. The rear edge 138 of the second sail sheet may extend from the lowermost surfaces of the first inflatable strut, and slope towards the first sail sheet until joining with the first sail sheet at points 143*a* and 143*b*. The rear edge 138 may therefore define portions 137 where the height of the wing sail reduces in the width direction towards the second inflatable strut.

Between the first inflatable strut and the point 143*a* where the first and second sail sheets 30 and 135 join one another, the first and second sail sheets are spaced apart from one another and so define an aperture 139 that leads into an interior region of the wing sail, similar to the aperture 39 of the wing sail 1. An equivalent aperture is also formed at the other side of the wing sail 2, between the first inflatable strut and the point 143*b*. One function of the apertures 139 is to allow any water that becomes trapped between the first and second sail sheets 30 and 135 to exit from the wing sail, to avoid the wing sail from becoming heavy and/or unwieldly.

The wing sail 2 may further comprise air intake ports 138*b* built into the second sail sheet 135, similar to the air intake ports 38 of the wing sail 1.

Many other variations of the described embodiments falling within the scope of the invention will be apparent to those skilled in the art.

The invention claimed is:

1. A wing sail, comprising a first inflatable strut extending in a width direction, a second inflatable strut extending in a length direction from the first inflatable strut, at least one handle mounted on the second inflatable strut, and first and second sail sheets that are spaced apart from one another in a height direction, wherein the first inflatable strut defines a leading edge of the wing sail, wherein the first and second sail sheets each comprise a front edge and a rear edge that are opposite to one another, wherein the front edges both connect to the first inflatable strut, and wherein the first and second sail sheets both extend rearwardly away from the first inflatable strut towards a trailing edge of the wing sail, wherein the second sail sheet is interrupted at the second inflatable strut to provide a user with access to the at least one handle and wherein the second sail sheet comprises a slit that is aligned with the second inflatable strut and that is at the location of the at least one handle.

2. The wing sail of claim 1, wherein the rear edge of the first sail sheet is located at the trailing edge of the wing sail and wherein the rear edge of the second sail sheet is located between 15% and 100% of the way in the length direction from the front edge of the second sail sheet to the trailing edge of the wing sail, over greater than a half of the full width of the wing sail.

3. The wing sail of claim 1, wherein the first sail sheet extends over or from an uppermost surface of the first inflatable strut and the second sail sheet extends over or from a lowermost surface of the first inflatable strut.

4. The wing sail of claim 3, wherein the first and second sail sheets each span from the first to the second inflatable struts.

5. The wing sail of claim 1, wherein the rear edges are both joined together along the trailing edge of the wing sail.

6. The wing sail of claim 1, wherein the rear edge of the second sail sheet comprises a portion adjacent the first inflatable strut, and wherein the height of the wing sail along that portion reduces in a direction along the width of the wing sail towards the second inflatable strut.

7. The wing sail of claim 1, wherein the extension of the first inflatable strut curves towards the length direction as the first inflatable strut extends away from the second inflatable strut.

8. The wing sail of claim 1, wherein the second inflatable strut extends from the first inflatable strut at a point that is mid-way along the first inflatable strut.

9. The wing sail of claim 1, comprising rib panels that each extend in the height and length directions and set a spacing between the first and second sail sheets.

10. The wing sail of claim 9, wherein the rib panels comprise apertures extending through them in the width direction.

11. The wing wing sail of claim 10, wherein each rib panel comprises a taper along the length direction of the rib panel, the taper reducing the height of the rib panel as the rib panel extends away from the leading edge of the wing sail.

12. The wing sail of claim 1, wherein the first or second sail sheets comprise air intake ports configured to inlet air to in between the first and second sail sheets.

13. The wing sail of claim 1, wherein the first sail sheet extends continuously over the second inflatable strut whilst extending between opposing ends of the first inflatable strut.

14. A wing sail comprising a first inflatable strut extending in a width direction, a second inflatable strut extending in a length direction from the first inflatable strut, at least one handle mounted on the second inflatable strut, and first and second sail sheets that are spaced apart from one another in a height direction, wherein the first inflatable strut defines a leading edge of the wing sail, wherein the first and second sail sheets each comprise a front edge and a rear edge that are opposite to one another, wherein the front edges both connect to the first inflatable strut, and wherein the first and second sail sheets both extend rearwardly away from the first inflatable strut towards a trailing edge of the wing sail, and further comprising a centre panel that extends in the height and length directions and that sets a spacing between an upper side of the second inflatable strut and the first sail sheet.

15. A wing sail, comprising a first inflatable strut extending in a width direction, a second inflatable strut extending in a length direction from the first inflatable strut, at least one handle mounted on the second inflatable strut, and first and second sail sheets that are spaced apart from one another in a height direction, wherein the first inflatable strut defines a leading edge of the wing sail, wherein the first and second sail sheets each comprise a front edge and a rear edge that are opposite to one another, wherein the front edges both connect to the first inflatable strut, and wherein the first and second sail sheets both extend rearwardly away from the first inflatable strut towards a trailing edge of the wing sail, and further comprising an aperture adjacent an end of the first inflatable strut, the aperture passing through at least one of the first and second sail sheets and opening into an interior region between the first and second sail sheets.

* * * * *